US011764519B2

(12) United States Patent
Mitsui et al.

(10) Patent No.: US 11,764,519 B2
(45) Date of Patent: Sep. 19, 2023

(54) WIRE INCLUDING TERMINAL PROVIDED WITH INSULATING BARREL PIECES

(71) Applicant: SUMITOMO WIRING SYSTEMS, LTD., Mie (JP)

(72) Inventors: Shohei Mitsui, Mie (JP); Norihito Hashimoto, Mie (JP); Motoki Kubota, Mie (JP); Keisuke Kanemura, Mie (JP); Wataru Yamanaka, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 82 days.

(21) Appl. No.: 17/473,198

(22) Filed: Sep. 13, 2021

(65) Prior Publication Data

US 2022/0085551 A1 Mar. 17, 2022

(30) Foreign Application Priority Data

Sep. 16, 2020 (JP) ..... 2020-155133

(51) Int. Cl.
*H01R 13/639* (2006.01)
*H01R 13/502* (2006.01)
*H01R 13/11* (2006.01)

(52) U.S. Cl.
CPC ..... *H01R 13/639* (2013.01); *H01R 13/111* (2013.01); *H01R 13/502* (2013.01)

(58) Field of Classification Search
CPC .. H01R 13/639; H01R 13/111; H01R 13/502; H01R 13/42; H01R 9/0518; H01R 24/38; H01R 4/185
See application file for complete search history.

(56) References Cited

U.S. PATENT DOCUMENTS

| | | | | |
|---|---|---|---|---|
| 9,257,759 | B2 * | 2/2016 | Nobukuni | H01R 4/305 |
| 9,356,388 | B2 * | 5/2016 | Aizawa | H01R 13/5227 |
| 10,734,762 | B2 * | 8/2020 | Kanemura | H01R 13/639 |
| 10,998,652 | B2 * | 5/2021 | Mitsui | H01R 13/6625 |
| 2003/0224656 | A1 * | 12/2003 | Yoshida | H01R 9/0518 439/578 |
| 2006/0264099 | A1 * | 11/2006 | Morikawa | H01R 9/05 439/578 |

(Continued)

FOREIGN PATENT DOCUMENTS

| | | | | |
|---|---|---|---|---|
| JP | 2006147223 A | * | 6/2006 | H01R 43/048 |
| JP | 2013-122881 A | | 6/2013 | |
| JP | 2016-091847 A | | 5/2016 | |

*Primary Examiner* — Abdullah A Riyami
*Assistant Examiner* — Nader J Alhawamdeh
(74) *Attorney, Agent, or Firm* — Venjuris, P.C.

(57) ABSTRACT

A terminal includes a wire barrel and an insulation barrel. The wire barrel includes a wire barrel base portion, a one-side wire barrel piece and an other-side wire barrel piece to be laid on an outer periphery of the one-side wire barrel piece. The insulation barrel includes an insulation barrel base portion connected to and behind the wire barrel base portion, a one-side insulation barrel piece for covering one side of an outer periphery of a coating and an other-side insulation barrel piece for covering the other side of the outer periphery of the coating. Tips of the respective one-side and other-side insulation barrel pieces are locked to the coating of a wire on a side closer to the other side than a center in a width direction of the insulation barrel.

3 Claims, 5 Drawing Sheets

(56) References Cited

U.S. PATENT DOCUMENTS

| | | | | |
|---|---|---|---|---|
| 2006/0288757 | A1* | 12/2006 | Nishio | H01R 4/184<br>73/1.02 |
| 2012/0329341 | A1* | 12/2012 | Morikawa | H01R 4/185<br>439/866 |
| 2017/0179663 | A1* | 6/2017 | Miyakawa | H01R 4/185 |
| 2017/0324172 | A1* | 11/2017 | Myer | H01R 4/185 |
| 2018/0034167 | A1* | 2/2018 | Hamada | H01R 4/185 |
| 2022/0085535 | A1* | 3/2022 | Mitsui | H01R 13/502 |
| 2022/0085551 | A1* | 3/2022 | Mitsui | H01R 13/502 |

* cited by examiner

WIRE INCLUDING TERMINAL PROVIDED WITH INSULATING BARREL PIECES

CROSS-REFERENCE TO RELATED APPLICATIONS

This application is based on and claims priority from Japanese Patent Application No. 2020-155133, filed on Sep. 16, 2020, with the Japan Patent Office, the disclosure of which is incorporated herein in their entireties by reference.

TECHNICAL FIELD

The present disclosure relates to a wire with terminal.

BACKGROUND

Japanese Patent Laid-open Publication Nos. 2016-091847, 2007-005202 and 2013-122881 disclose a wire with terminal in which a terminal is crimped to a wire. For example, a terminal of a wire with terminal of Japanese Patent Laid-open Publication No. 2016-091847 includes a wire barrel and an insulation barrel. The wire barrel is crimped to a conductor exposed by removing a coating from a tip part of a wire. The wire barrel includes extending portions respectively extending from both widthwise sides. The one-side extending portion extending from one side, out of the both extending portions, is wound on the exposed conductor of the wire. The other-side extending portion extending from the other side is wound on the outer peripheral surface of the one-side extending portion. The insulation barrel is crimped to the coating of the wire. A method for winding extending portions extending from both widthwise sides on a wire and crimping the extending portions to press the tips thereof toward the inside of the wire is known as a method for crimping an insulation barrel.

SUMMARY

In the case of Japanese Patent Laid-open Publication No. 2016-091847, when the one-side extending portion of the wire barrel is wound, the one-extending portion of the insulation barrel may be pulled by the one-side extending portion of the wire barrel and the tip thereof may be arranged closer to the other side. Thus, in a configuration in which the respective tips of the insulation barrel are crimped to be pressed toward the inside of the wire, the other-side extending portion of the insulation barrel may butt against the outer peripheral surface of the one-side extending portion without being pushed toward the inside of the wire, with the result that a holding force may be reduced.

Accordingly, the present disclosure aims to suppress a reduction of a holding force of a terminal to hold the wire.

The present disclosure is directed to a wire with terminal including a wire, and a terminal to be connected to the wire, wherein the wire includes a conductor and a coating for covering an outer periphery of the conductor, the wire includes a conductor exposed portion in which an outer peripheral surface of the conductor is exposed, the terminal includes a wire barrel and an insulation barrel, the wire barrel includes a wire barrel base portion, a one-side wire barrel piece extending from an end part of the wire barrel base portion on one side in a width direction toward the other side to cover an outer periphery of the conductor exposed portion and an other-side wire barrel piece extending from an end part of the wire barrel base portion on the other side to be laid on an outer periphery of the one-side wire barrel piece, the insulation barrel includes an insulation barrel base portion connected to and behind the wire barrel base portion, a one-side insulation barrel piece extending from an end part of the insulation barrel piece on the one side to cover the one side of an outer periphery of the coating, and an other-side insulation barrel piece extending from an end part of the insulation barrel base portion on the other side to cover the other side of the outer periphery of the coating, and tips of the respective one-side and other-side insulation barrel pieces are locked to the coating on a side closer to the other side than a center in the width direction of the insulation barrel.

According to the present disclosure, it is possible to suppress a reduction of a holding force of a terminal to hold the wire.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
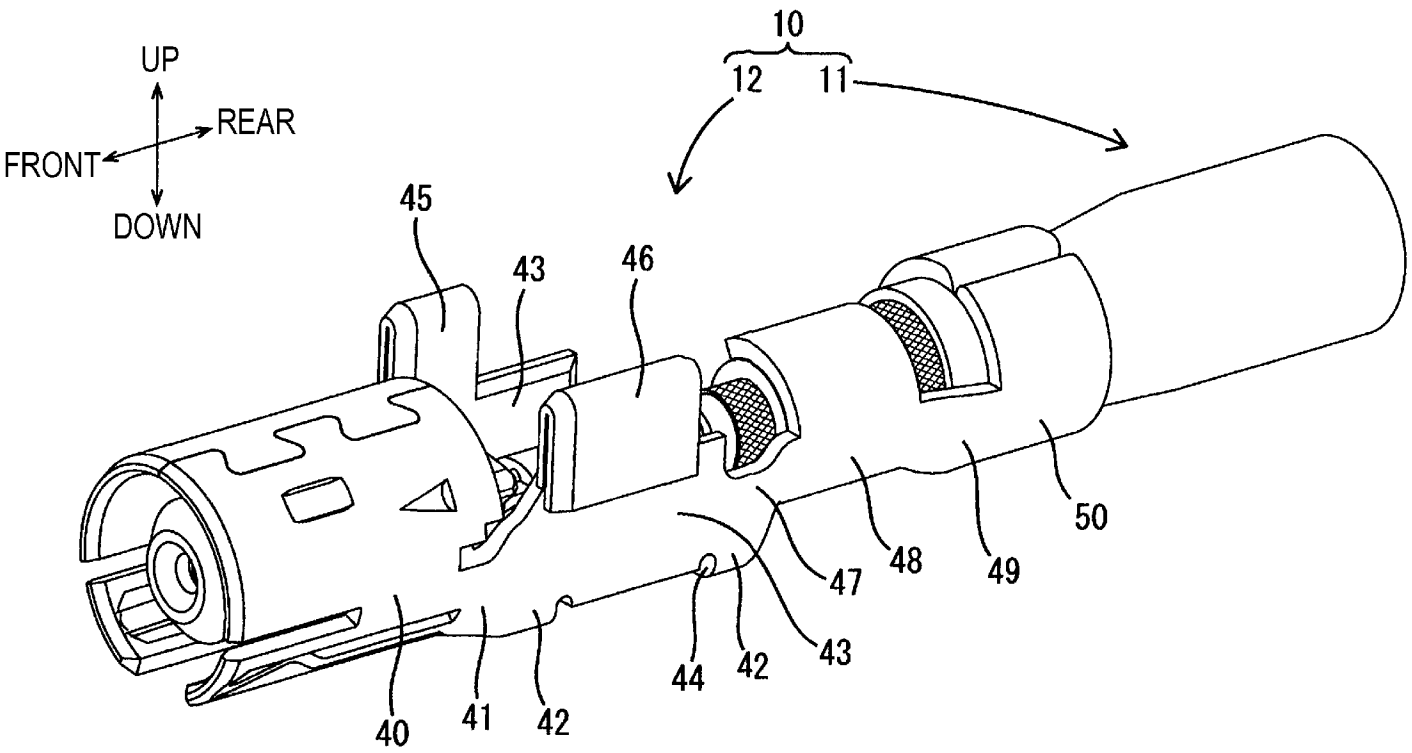
FIG. 1 is a perspective view of a wire with terminal according to one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The wire with terminal of the present disclosure includes a wire, and a terminal to be connected to the wire, wherein the wire includes a conductor and a coating for covering an outer periphery of the conductor, the wire includes a conductor exposed portion in which an outer peripheral surface of the conductor is exposed, the terminal includes a wire barrel and an insulation barrel, the wire barrel includes a wire barrel base portion, a one-side wire barrel piece extending from an end part of the wire barrel base portion on one side in a width direction toward the other side to cover an outer periphery of the conductor exposed portion and an other-side wire barrel piece extending from an end part of the wire barrel base portion on the other side to be laid on an outer periphery of the one-side wire barrel piece, the insulation barrel includes an insulation barrel base portion connected to and behind the wire barrel base portion, a one-side insulation barrel piece extending from an end part of the insulation barrel piece on the one side to cover the one side of an outer periphery of the coating, and an other-side insulation barrel piece extending from an end part of the insulation barrel base portion on the other side to cover the other side of the outer periphery of the coating, and tips of the respective one-side and other-side insulation barrel pieces are locked to the coating on a side closer to the other side than a center in the width direction of the insulation barrel.

In this wire with terminal, the tips of the respective one-side and other-side insulation barrel pieces are arranged on the side closer to the other side than the center in the width direction of the insulation barrel piece. Thus, even if the one-side insulation barrel piece is pulled toward the other side by the one-side wire barrel piece when the one-side wire barrel piece of the wire barrel is wound on the outer periphery of the wire, the one-side insulation barrel piece is unlikely to move toward the other side beyond a position where the one-side insulation barrel piece is supposed to be arranged. Hence, the tip of the other-side insulation barrel piece is easily locked to the coating of the wire without butting against the one-side insulation barrel piece. Therefore, a reduction of a holding force of the terminal to hold the wire is suppressed.

(2) Preferably, the conductor includes a center conductor and a shield conductor for covering an outer periphery of the center conductor via an insulator and the coating covers an outer periphery of the shield conductor, and the respective one-side and other-side insulation barrel pieces are curved and arranged to face each other in the width direction at positions near the tips.

The tips of the respective one-side and other-side insulation barrel pieces are locked to the coating with the insulation barrel pieces facing each other in the width direction at the positions near the tips. Thus, the shield conductor can receive a uniform pressing force from the respective one-side and other-side insulation barrel pieces as compared to a configuration in which the one-side and other-side insulation barrel pieces are arranged at positions shifted not to face each other. As a result, partially biased deformation is suppressed in the shield conductor, wherefore a variation of shielding performance corresponding to a part of the shield conductor hardly occurs.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

Figure 2:
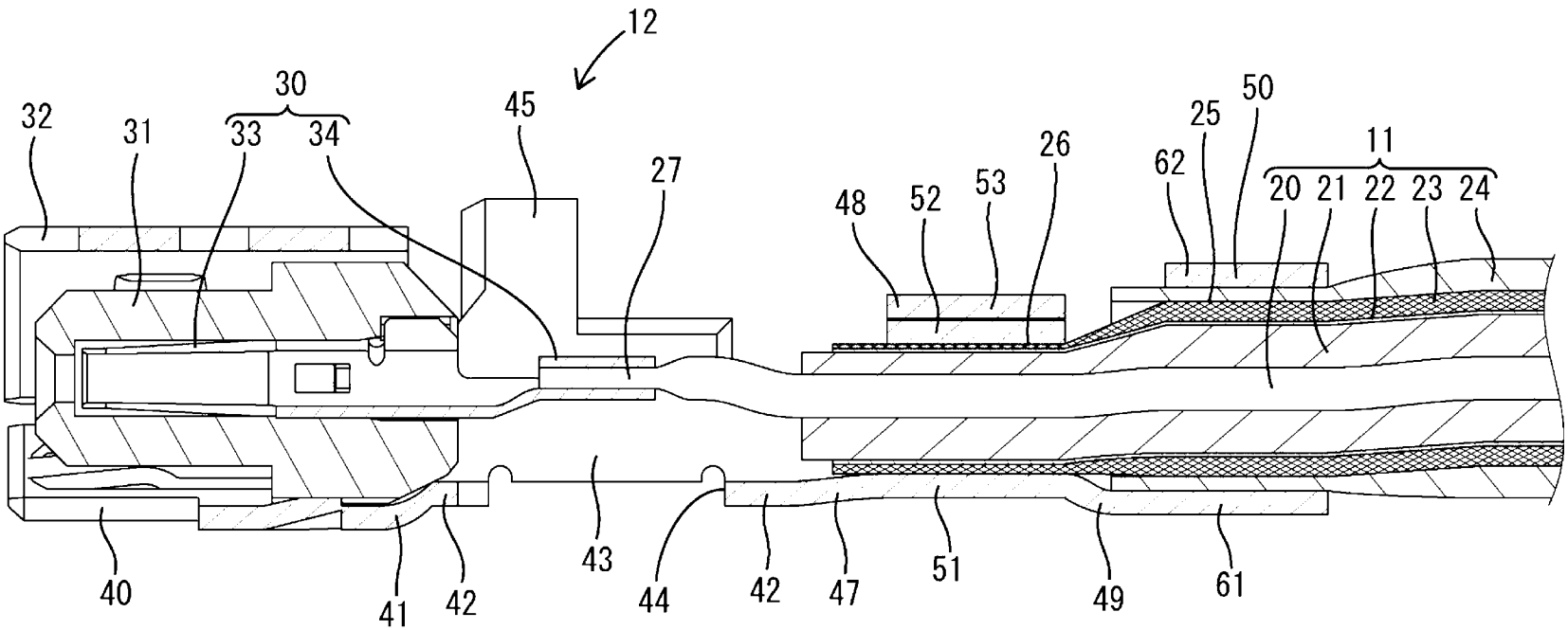
FIG. 2 is a side view in section of the wire with terminal according to the one embodiment.
Figure 4:
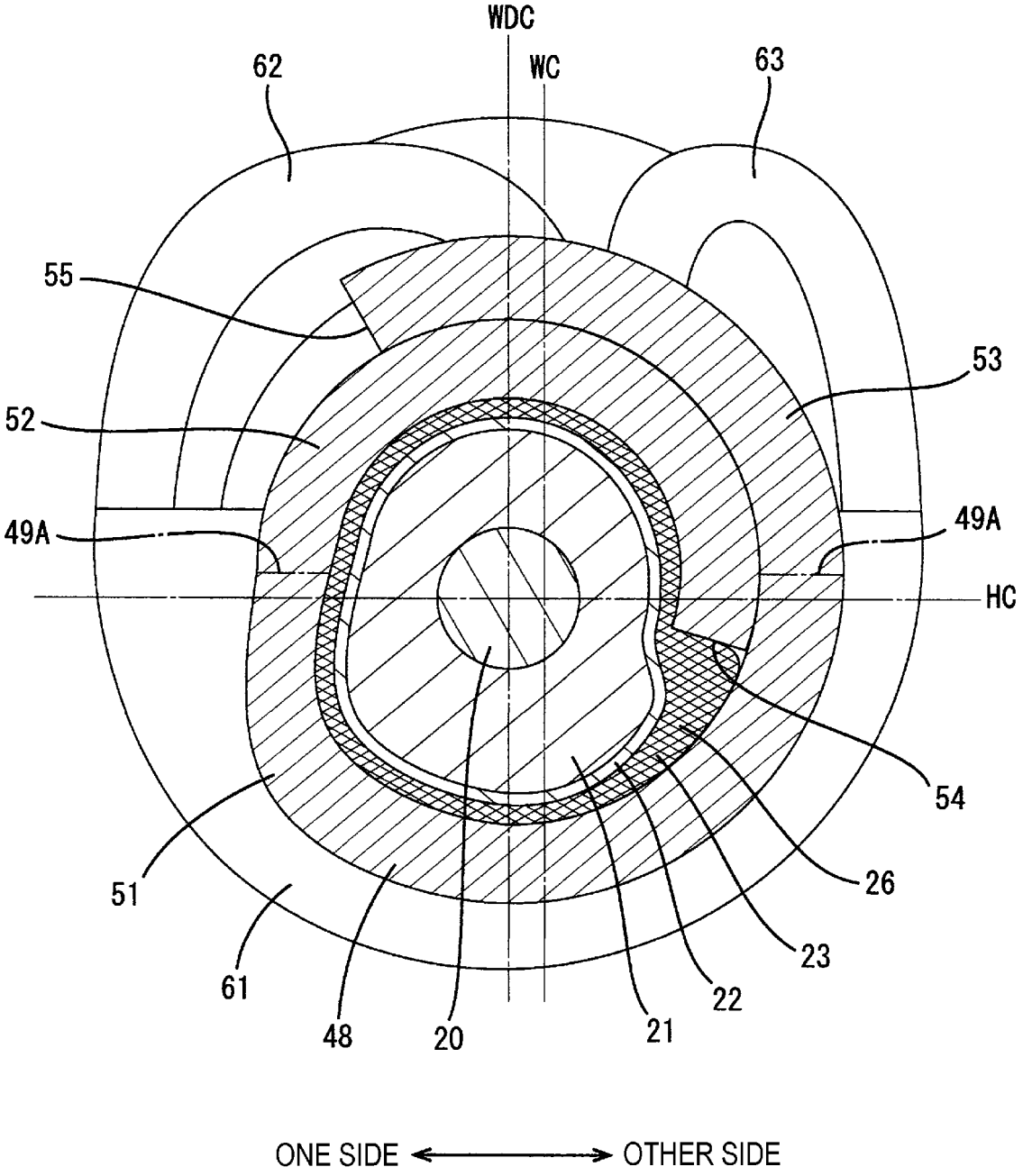
FIG. 4 is a transverse section of a part including a wire barrel in the wire with terminal.
Figure 5:
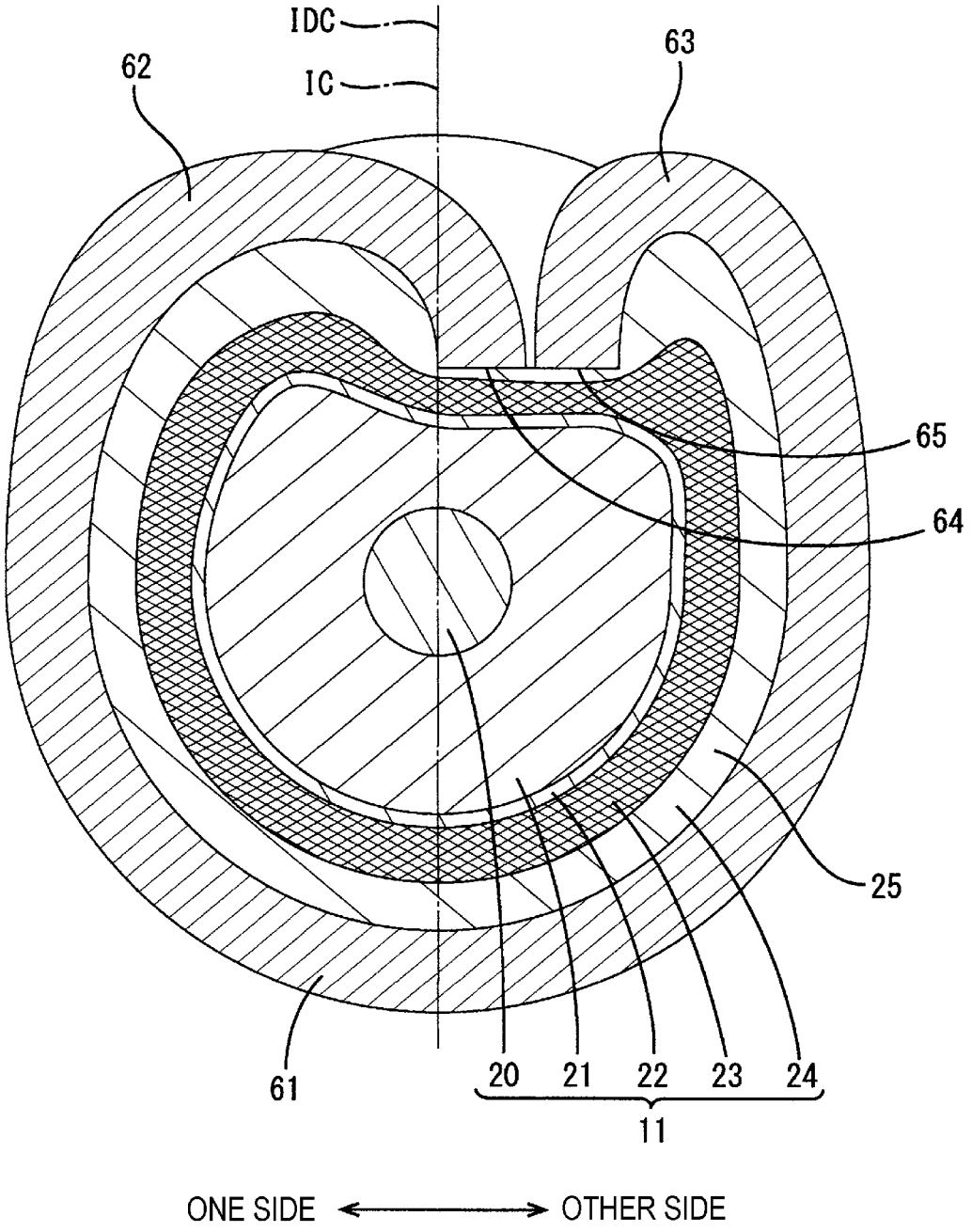
FIG. 5 is a transverse section of a part including an insulation barrel in the wire with terminal.

A wire with terminal 10 is illustrated in one embodiment. As shown in FIG. 1, the wire with terminal 10 includes a wire 11 and a terminal 12 and the wire 11 is crimped to the terminal 12. Note that, in the following description, a side of the wire with terminal 10 to be connected to an unillustrated mating terminal is referred to as a front side and an opposite side is referred to as a rear side. Further, a vertical direction in FIGS. 2, 4 and 5 is directly referred to as a vertical direction. Further, a lateral direction viewed from the front side is referred to as a lateral direction. Note that the lateral direction corresponds to an example of a "width direction", a left side corresponds to an example of "one side in the width direction" and a right side corresponds to an example of an "other side in the width direction". Further, the vertical direction is a height direction of the wire with terminal 10.

Figure 3:
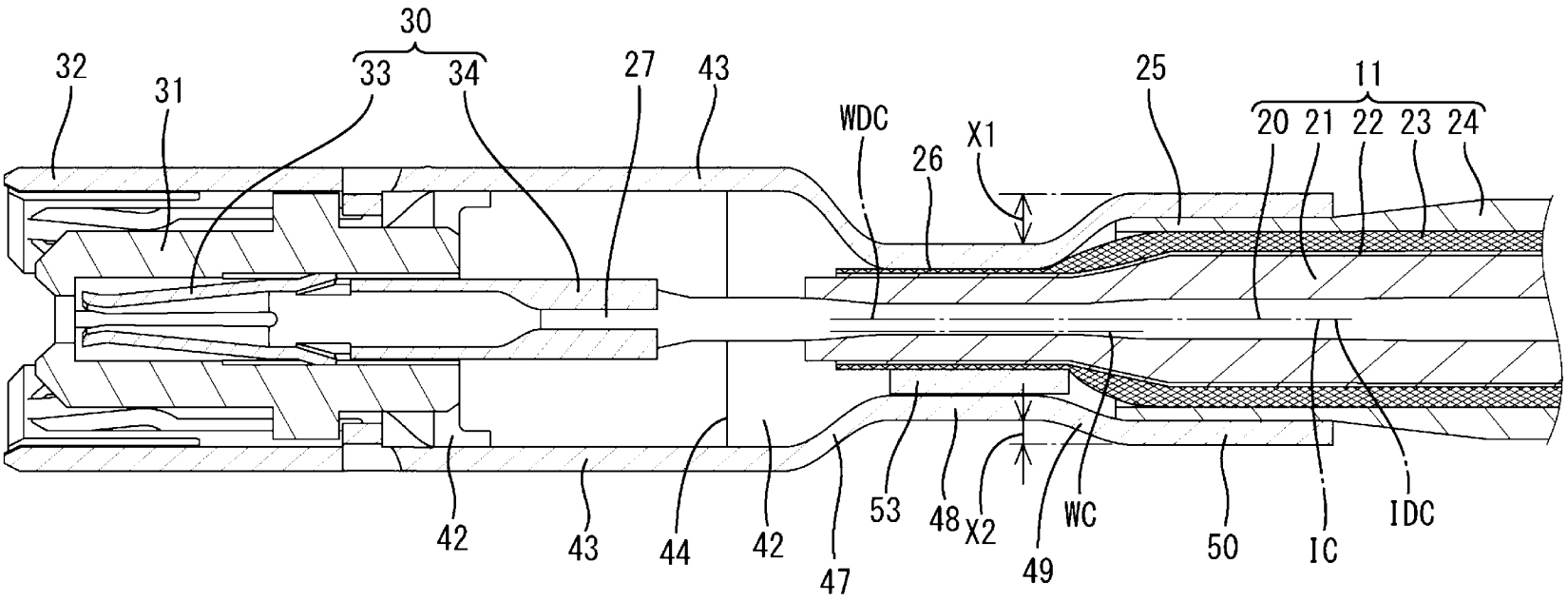
FIG. 3 is a plan view in section of the wire with terminal according to the one embodiment.

As shown in FIGS. 2 and 3, the wire 11 is a coaxial cable. The wire 11 includes a center conductor 20, an insulator 21, a first shield conductor 22, a second shield conductor 23 and a coating 24 from a center toward an outer periphery. The center conductor 20 and the first and second shield conductors 22, 23 correspond to an example of a "conductor". The first and second shield conductors 22, 23 correspond to an example of a "shield conductor". The center conductor 20 is, for example, a conductive core formed by twisting a plurality of strands. The center conductor 20 transmits a high-frequency signal. The insulator 21 covers the outer periphery of the center conductor 20. The first and second shield conductors 22, 23 cover the outer periphery of the insulator 21. The first shield conductor 22 is arranged inwardly of the second shield conductor 23. The first shield conductor 22 is, for example, configured as a metal foil (e.g. copper foil). The second shield conductor 23 is, for example, configured as a conductive braided wire formed by braiding strands. The first and second shield conductors 22, 23 have a function of shielding electromagnetic waves. The coating 24 has an insulating property and covers the outer periphery of the second shield conductor 23.

The wire 11 includes a non-exposed portion 25, a shield conductor exposed portion 26 and a center conductor exposed portion 27 from the rear side toward the front side. The shield conductor exposed portion 26 corresponds to an example of a "conductor exposed portion". The non-exposed portion 25 is a part where the outer peripheral surface of the conductor (in this embodiment, the center conductor 20, the first and second shield conductors 22, 23) is not exposed. That is, the non-exposed portion 25 is a part having the coating 24 as an outermost layer. The shield conductor exposed portion 26 is a part where the outer peripheral surface of the second shield conductor 23 is exposed. The center conductor exposed portion 27 is a part where the outer peripheral surface of the center conductor 20 is exposed. The shield conductor exposed portion 26 and the center conductor exposed portion 27 are arranged in a tip part of the wire 11. The center conductor exposed portion 27 is arranged closer to a tip side than the shield conductor exposed portion 26. In the tip part of the wire 11, the shield conductor exposed portion 26 is formed by removing the coating 24. In a tip part of the shield conductor exposed portion 26, the center conductor exposed portion 27 is formed by removing the insulator 21 and the first and second shield conductors 22, 23.

The terminal 12 includes an inner conductor terminal 30, a dielectric 31 and an outer conductor terminal 32. The inner conductor terminal 30 is made of a conductive metal material and has a shape long in a front-rear direction. The inner conductor terminal 30 includes a terminal connecting portion 33 and a center conductor connecting portion 34. The terminal connecting portion 33 is in the form of a hollow cylinder open in the front-rear direction and connected to an unillustrated mating terminal. The center conductor connecting portion 34 is arranged behind the terminal connecting portion 33 and connected to the center conductor exposed portion 27 of the wire 11 by crimping or the like.

The dielectric 31 is made of an insulating synthetic resin material. The dielectric 31 is in the form of a hollow cylinder open in the front-rear direction and arranged on an outer peripheral side of the inner conductor terminal 30.

The outer conductor terminal 32 is conductive and formed, such as by bending a metal plate. The outer conductor terminal 32 includes a tube portion 40, a first coupling portion 41, a bottom wall portion 42 and side wall portions 43 and an opening 44. The tube portion 40 is in the form of a hollow cylinder open in the front-rear direction. The tube portion 40 covers the outer periphery of the terminal connecting portion 33 of the inner conductor terminal 30 via the dielectric 31. The bottom wall portion 42 and the side wall portions 43 are connected to the rear end of the tube portion 40 via the first coupling portion 41. The bottom wall portion 42 is in the form of a flat surface extending along the front-rear direction and the lateral direction. A direction orthogonal to the surface of the bottom wall portion 42 is the height direction of the wire with terminal 10. The side wall portions 43 rise from both left and right sides of the bottom wall portion 42 and are in the form of flat surfaces extending along the front-rear direction and the vertical direction. A direction parallel to the surfaces of the side wall portions 43 and orthogonal to the front-rear direction is the height direction of the wire with terminal 10. The side wall portions 43 are arranged on both left and right sides of the center conductor connecting portion 34. The opening 44 vertically penetrates through the bottom wall portion 42. The opening 44 is arranged below the center conductor connecting portion 34. The center conductor connecting portion 34 is exposed vertically of the terminal 12. Note that upper and lower sides of the center conductor connecting portion 34 are covered by an unillustrated cover made of metal after the center conductor connecting portion 34 is crimped to the center conductor exposed portion 27.

The outer conductor terminal 32 includes a first stabilizer 45 and a second stabilizer 46. The first stabilizer 45 extends upward from the upper end of the left side wall portion 43 and is folded outwardly. The second stabilizer 46 extends upward from the upper end of the right side wall portion 43 and is folded outwardly. The first and second stabilizers 45, 46 are retained and held by being locked to an unillustrated housing.

The outer conductor terminal 32 includes a second coupling portion 47, a wire barrel 48, a third coupling portion 49 and an insulation barrel 50. The second coupling portion 47 is a part coupling the rear ends of the bottom wall portion 42 and the side wall portions 43 and the front end of the wire barrel 48. The second coupling portion 47 has an arched transverse cross-sectional shape open upward and becomes smaller toward the rear side as shown in FIG. 3. The third coupling portion 49 is a part coupling the wire barrel 48 and the insulation barrel 50. The third coupling portion 49 has an arched transverse cross-sectional shape open upward and becomes larger toward the rear side as shown in FIG. 3.

As shown in FIG. 4, the wire barrel 48 is a part to be crimped to the shield conductor exposed portion 26 of the wire 11. The wire barrel 48 is in the form of an open barrel open upward before being crimped to the wire 11. The wire barrel 48 includes a wire barrel base portion 51, a one-side wire barrel piece 52 and an other-side wire barrel piece 53. The wire barrel base portion 51 is connected to the bottom wall portion 42 and the side wall portions 43 via the second coupling portion 47.

The wire barrel base portion 51 has an arched transverse cross-sectional shape open upward and the shape and size thereof are constant in the front-rear direction. The shield conductor exposed portion 26 of the wire 11 is arranged on the upper surface of the wire barrel base portion 51. The wire barrel base portion 51 covers a lower part of the shield conductor exposed portion 26 of the wire 11.

The one-side wire barrel piece 52 extends from the left end of the wire barrel base portion 51 and is wound on an upper part of the shield conductor exposed portion 26. The one-side wire barrel piece 52 is shaped to arcuately extend rightward from the left end of the wire barrel base portion 51 and covers the upper part of the shield conductor exposed portion 26. A tip 54 of the one-side wire barrel piece 52 is arranged below a height position of a base end part 49A of the third coupling portion 49 with the wire barrel 48.

The other-side wire barrel piece 53 extends from the right end of the wire barrel base portion 51 and is wound on the outer peripheral surface of the one-side wire barrel piece 52. The other-side wire barrel piece 53 is shaped to arcuately extend leftward from the right end of the wire barrel base portion 51 and laid on the outer peripheral surface of the one-side wire barrel piece 52. The other-side wire barrel piece 53 is at least partially doubly arranged with the one-side wire barrel piece 52 on a right side of a center WC in the lateral direction of the wire barrel 48. A tip 55 of the other-side wire barrel piece 53 is arranged to the left of the center WC in the lateral direction of the wire barrel 48 and to the right of a leftmost end of the wire barrel 48.

A center WDC in the lateral direction of the shield conductor exposed portion 26 covered by the wire barrel 48 is shifted leftward with respect to the center WC in the lateral direction of the wire barrel 48 in advance. Here, the center WDC in the lateral direction of the shield conductor exposed portion 26 means a center in the lateral direction of the center conductor 20 in the shield conductor exposed portion 26.

At a height position HC of the center of the shield conductor exposed portion 26, the one-side wire barrel piece 52 is singly arranged on a left side of the shield conductor exposed portion 26 and the one-side wire barrel piece 52 and the other-side wire barrel piece 53 or the wire barrel base portion 51 are doubly arranged in the lateral direction on a right side. Here, the height position HC of the center of the shield conductor exposed portion 26 means a height position of the center of the center conductor 20 in the shield conductor exposed portion 26.

A maximum width in the lateral direction of the wire barrel 48 is smaller than that of the insulation barrel 50. A distance X1 in the lateral direction between the leftmost end of the wire barrel 48 and that of the insulation barrel 50 is longer than a distance X2 in the lateral direction between the rightmost end of the wire barrel 48 and that of the insulation barrel 50 (see FIG. 3).

As shown in FIG. 5, the insulation barrel 50 is a part to be crimped to the non-exposed portion 25, i.e. the coating 24, of the wire 11. The insulation barrel 50 is in the form of an open barrel open upward before being crimped to the wire 11. The insulation barrel 50 includes an insulation barrel base portion 61, a one-side insulation barrel piece 62 and an other-side insulation barrel piece 63.

The insulation barrel base portion 61 has an arched transverse cross-sectional shape open upward and the shape and size thereof are constant in the front-rear direction. The front end of the insulation barrel base portion 61 is connected to the rear end of the wire barrel base portion 51 via the third coupling portion 49. The coating 24 of the wire 11 is arranged on the upper surface of the insulation barrel base portion 61. The insulation barrel base portion 61 covers a lower half of the coating 24 of the wire 11.

The one-side insulation barrel piece 62 extends from the left end of the wire barrel base portion 61 and covers upper and left parts of the outer peripheral surface of the coating 24. The other-side insulation barrel piece 63 extends from the right end of the insulation barrel base portion 61 and covers upper and right parts of the outer peripheral surface of the coating 24. A tip 64 of the one-side insulation barrel piece 62 and a tip 65 of the other-side insulation barrel pieces 63 are respectively locked to the coating 34 on a right side of a center IC in the lateral direction of the insulation barrel 50.

The one-side and other-side insulation barrel pieces 62, 63 are in the following state while being locked to the wire 11 as shown in FIG. 5. Each of the one-side and other-side insulation barrel pieces 62, 63 is curved. The one-side and other-side insulation barrel pieces 62, 63 are arranged to face each other in the lateral direction at positions near the tips 64, 65. The one-side and other-side insulation barrel pieces 62, 63 are highest at the same height position. The tip 64 of the one-side insulation barrel piece 62 and the tip 65 of the other-side insulation barrel piece 63 are at the same height.

Next, a manufacturing method, functions and effects of the wire with terminal 10 are described.

In the wire 11, the shield conductor exposed portion 26 is formed by removing the coating 24 in the tip part and the center conductor exposed portion 27 is formed by removing the insulator 21 and the first and second shield conductors 22, 23. Note that the outer peripheral surface of the insulator 21 is slightly exposed in front of the shield conductor exposed portion 26.

In the terminal 12, the inner conductor terminal 30 and the outer conductor terminal 32 are respectively manufactured, such as by bending a metal plate. The dielectric 31 is resin-molded. The inner conductor terminal 30 is arranged in the tube portion 40 of the outer conductor terminal 32 via the dielectric 31. The terminal 12 is crimped to the wire 11 with displacements of the bottom wall portion 42 and the side wall portions 43 restricted. That is, the bottom wall portion 42 and the side wall portions 43 define the vertical and lateral directions. Specifically, the center conductor connecting portion 34 of the outer conductor terminal 32 is crimped to the center conductor exposed portion 27 of the wire 11. The wire barrel 48 of the outer conductor terminal 32 is crimped to the shield conductor exposed portion 26 of the wire 11. The insulation barrel 50 of the outer conductor terminal 32 is crimped to the coating 24 of the wire 11.

In crimping the wire barrel 48 to the shield conductor exposed portion 26, the shield conductor exposed portion 26 is first arranged on the upper surface of the wire barrel base portion 51, the one-side wire barrel piece 52 is wound on the outer peripheral surface of the shield conductor exposed portion 26 and the other-side wire barrel piece 53 is laid on the outer peripheral surface of the one-side wire barrel piece 52. At this time, the tip of the one-side wire barrel piece 52 is arranged inside the other-side wire barrel piece 53 on the right side of the center WC in the lateral direction of the shield conductor exposed portion 26. Thus, the tip of the one-side wire barrel piece 52 is pressed leftward by the other-side wire barrel piece 53 to press a right part of the shield conductor exposed portion 26 leftward. As a result, the center conductor 20 in the shield conductor exposed portion 26 is shifted leftward with respect to the center WC in the lateral direction of the wire barrel 48. However, the center WC in the lateral direction of the wire barrel 48 is shifted rightward with respect to a center IDC in the lateral direction of the wire 11 held by the insulation barrel 50 in advance. Here, the center IDC in the lateral direction of the wire 11 held by the insulation barrel 50 means a center in the lateral direction of the center conductor 20 in the wire 11 held by the insulation barrel 50. Thus, a deviation between the center IDC in the lateral direction of the wire 11 held by the insulation barrel 50 and the center WDC in the lateral direction of the shield conductor exposed portion 26 covered by the wire barrel 48 is eliminated or reduced. As a result, the wire 11, in particular the center conductor 20, is linearly arranged in the front-rear direction as a whole in a plan view shown in FIG. 3. Therefore, according to this wire with terminal 10, a deviation of the wire 11 connected to the terminal 12 can be suppressed.

Particularly, in this embodiment, the tips 64, 65 of the respective one-side and other-side insulation barrel pieces 62, 63 are locked to the coating 24 of the wire 11. Thus, the wire 11 can be held with a high holding force. Further, according to this wire with terminal 10, the one-side and other-side insulation barrel pieces 62, 63 do not overlap each other in a radial direction of the wire 11. Thus, a deviation of the center IDC in the lateral direction of the wire 11 held by the insulation barrel 50 with respect to the center IC in the lateral direction of the insulation barrel 50 can be suppressed.

Further, in this embodiment, the one-side wire barrel piece 52 is singly arranged on the left side of the shield conductor exposed portion 26 and the one-side wire barrel piece 52 and the other-side wire barrel piece 53 or the wire barrel base portion 51 are doubly arranged in the lateral direction on the right side of the shield conductor exposed portion 26 at the height position HC of the center of the shield conductor exposed portion 26. Thus, at the height position HC of the center of the shield conductor exposed portion 26, the center WDC in the lateral direction of the shield conductor exposed portion 26 deviates by a plate thickness of each of the one-side and other-side wire barrel pieces 52, 53. Therefore, an adjustment for suppressing the deviation is easy.

Further, in crimping the wire barrel 48 to the shield conductor exposed portion 26, the shield conductor exposed portion 26 is first arranged on the upper surface of the wire barrel base portion 51 and the one-side wire barrel piece 52 is wound on the outer peripheral surface of the shield conductor exposed portion 26. At this time, the one-side insulation barrel piece 62 is also pulled rightward by the one-side wire barrel piece 52. Thus, the one-side insulation barrel piece 62 may be arranged at a rightward shifted position when being wound on the coating 24 of the wire 11. In this case, the tip 65 of the other-side insulation barrel piece 63 may butt against the outer peripheral surface of the one-side insulation barrel piece 62 and not be locked to the wire 11. Such a problem also occurs when the winding of the one-side wire barrel piece 52 and the winding of the one-side and other-side insulation barrel pieces 62, 63 are separately performed and when they are simultaneously performed, but is particularly notable when they are simultaneously performed.

However, in this wire with terminal 10, the tips 64, 65 of the respective one-side and other-side insulation barrel pieces 62, 63 are arranged to the right of the center IDC in the lateral direction of the wire 11 held by the insulation barrel 50. Thus, even if the one-side insulation barrel piece 62 is pulled rightward by the one-side wire barrel piece 52 when the one-side wire barrel piece 52 of the wire barrel 48 is wound on the outer periphery of the wire 11, the one-side insulation barrel piece 62 is unlikely to move rightward beyond a position where the one-side insulation barrel piece 62 is supposed to be arranged. Hence, the tip of the other-side insulation barrel piece 63 is easily locked to the coating 24 of the wire 11 without butting against the one-side insulation barrel piece 62. Therefore, a reduction of a holding force of the terminal 12 to hold the wire 11 is suppressed.

Further, the wire 11 is configured as a coaxial cable. Thus, no variation in shielding performance is preferable also in a crimped part. Accordingly, the wire with terminal 10 is configured as follows. In crimping the insulation barrel 50 to the coating 24 of the wire 11, each of the one-side and other-side insulation barrel pieces 62, 63 is deformed to be curved. Then, the tips 64, 65 of the respective one-side and other-side insulation barrel pieces 62, 63 are caused to bite into the wire 11. In this way, the one-side and other-side insulation barrel pieces 62, 63 are arranged to face each other in the lateral direction at positions near the tips 64, 65. Thus, the first and second shield conductors 22, 23 can receive a uniform pressing force from the respective one-side and other-side insulation barrel pieces 62, 63 as compared to a configuration in which the one-side and other-side insulation barrel pieces 62, 63 are arranged at positions shifted not to face each other. As a result, partially biased deformation is suppressed in the first and second shield conductors 22, 23, wherefore a variation of shielding performance corresponding to parts of the first and second shield conductors 22, 23 hardly occurs.

Other Embodiments of Present Disclosure

The embodiment disclosed this time should be considered illustrative in all aspects, rather than restrictive.

(1) Although the wire is a coaxial cable in the above embodiment, it may not be a coaxial cable and may be, for example, a wire in which a center conductor is directly covered with a coating.

(2) Although the insulation barrel is coupled to the wire barrel via the third coupling portion in the above embodiment, the insulation barrel may be directly coupled to the wire barrel.

(3) The insulation barrel may have a shape different from that of the above embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A wire with terminal, comprising:

a wire; and a terminal to be connected to the wire, wherein:

the wire includes a conductor and a coating configured to cover an outer periphery of the conductor, the wire includes a conductor exposed portion in which an outer peripheral surface of the conductor is exposed, the terminal includes a wire barrel and an insulation barrel, the wire barrel includes:

a wire barrel base portion;

a one-side wire barrel piece extending from an end part of the wire barrel base portion on one side in a width direction toward the other side to cover an outer periphery of the conductor exposed portion; and a remaining-side wire barrel piece extending from an end part of the wire barrel base portion on a remaining side to be laid on an outer periphery of the one-side wire barrel piece, the insulation barrel includes:

an insulation barrel base portion connected to and behind the wire barrel base portion;

a one-side insulation barrel piece extending from an end part of the insulation barrel base portion on one side to cover the one side of an outer periphery of the coating, and a remaining-side insulation barrel piece extending from an end part of the insulation barrel base portion on a remaining side to cover a remaining side of the outer periphery of the coating, and tips of the one-side and the remaining-side insulation barrel pieces are locked to the coating on a side closer to the remaining side than a center in the width direction of the insulation barrel such that the tips bite into the coating toward an inside of the wire.

2. The wire with terminal of claim 1, wherein:

the conductor includes a center conductor and a shield conductor configured to cover an outer periphery of the center conductor via an insulator, the coating covers an outer periphery of the shield conductor, and the respective one-side and remaining-side insulation barrel pieces are curved and arranged to face each other in the width direction at positions near the tips.

3. The wire with terminal of claim 1, wherein the tips of the one-side and the remaining-side insulation barrel pieces are positioned at a same height inside the coating in a state where outer peripheral surfaces of the one-side and the remaining-side insulation barrel pieces face each other.

* * * * *